US006099276A

United States Patent [19]

Taguchi

[11] Patent Number: 6,099,276

[45] Date of Patent: Aug. 8, 2000

[54] VARIABLE DISPLACEMENT COMPRESSOR IMPROVED IN A LUBRICATION MECHANISM THEREOF

[75] Inventor: Yukihiko Taguchi, Maebashi, Japan

[73] Assignee: Sanden Corporation, Gunma, Japan

[21] Appl. No.: 09/153,355

[22] Filed: Sep. 15, 1998

[30] Foreign Application Priority Data

Sep. 25, 1997 [JP] Japan ..... 9-260345

[51] Int. Cl.[7] ..... F04B 39/10; F04B 53/10

[52] U.S. Cl. ..... 417/569; 417/222.2; 184/6.17

[58] Field of Search ..... 417/569, 222.2, 417/270, 269; 184/6.17, 6.24

[56] References Cited

U.S. PATENT DOCUMENTS

| | | | |
|---|---|---|---|
| 4,037,993 | 7/1977 | Roberts | 417/222 |
| 4,073,603 | 2/1978 | Abendschein et al. | 417/222 |
| 4,425,837 | 1/1984 | Livesay | 92/71 |
| 4,480,964 | 11/1984 | Skinner | 417/222 |
| 4,586,874 | 5/1986 | Hiraga et al. | 417/222 |
| 4,664,604 | 5/1987 | Terauchi | 417/222 |
| 4,685,866 | 8/1987 | Takenaka et al. | 417/222 |
| 4,687,419 | 8/1987 | Suzuki et al. | 417/222 |
| 4,688,997 | 8/1987 | Suzuki et al. | 417/222 |
| 4,702,677 | 10/1987 | Takenaka et al. | 417/222 |
| 4,723,891 | 2/1988 | Takenaka et al. | 417/222 |
| 4,730,986 | 3/1988 | Kayukawa et al. | 417/222 |
| 4,778,348 | 10/1988 | Kikuchi et al. | 417/222 |
| 4,780,059 | 10/1988 | Taguchi | 417/222 |
| 4,780,060 | 10/1988 | Terauchi | 417/222 |
| 4,842,488 | 6/1989 | Terauchi | 417/222 |
| 4,940,393 | 7/1990 | Taguchi | 417/222 |
| 4,960,367 | 10/1990 | Terauchi | 417/222 |
| 5,051,067 | 9/1991 | Terauchi | 417/222 R |
| 5,080,561 | 1/1992 | Taguchi | 417/222 |
| 5,092,741 | 3/1992 | Taguchi | 417/222 |
| 5,094,589 | 3/1992 | Terauchi et al. | 417/222 S |
| 5,145,326 | 9/1992 | Kimura et al. | 417/222.2 |
| 5,286,172 | 2/1994 | Taguchi | 417/222.2 |
| 5,370,505 | 12/1994 | Takenaka et al. | 417/269 |
| 5,547,346 | 8/1996 | Kanzaki et al. | 417/222.2 |
| 5,567,124 | 10/1996 | Takenaka et al. | 417/222.2 |
| 5,588,807 | 12/1996 | Kimura et al. | 417/222.2 |
| 5,603,610 | 2/1997 | Kawaguchi et al. | 417/222.2 |
| 5,616,008 | 4/1997 | Yokono et al. | 417/222.2 |

FOREIGN PATENT DOCUMENTS

| | | |
|---|---|---|
| 0219283 | 10/1986 | European Pat. Off. . |
| 474549 | 11/1992 | Japan . |

*Primary Examiner*—Henry C. Yuen
*Assistant Examiner*—Mahmoud M. Gimie
*Attorney, Agent, or Firm*—Baker Botts L.L.P.

[57] ABSTRACT

A variable displacement compressor controls a discharge displacement by changing an inclination of a swash plate (5) depending on a pressure differential between a crank chamber (3) and a suction chamber (13) thereby to change a piston stroke. A first communication passage (18) establishes communication between the crank chamber and the suction chamber. A first orifice (19) is provided in the first communication passage. A second communication passage (20) establishes communication between a discharge chamber (14) and the crank chamber. A pressure control valve (21) open/close controls the second communication passage so as to adjust a pressure in the crank chamber. A third communication passage (22) establishes communication between the discharge chamber and the crank chamber, bypassing the second communication passage. A second orifice (23) is provided in the third communication passage.

8 Claims, 4 Drawing Sheets

VARIABLE DISPLACEMENT COMPRESSOR IMPROVED IN A LUBRICATION MECHANISM THEREOF

BACKGROUND OF THE INVENTION

The present invention relates to a variable displacement compressor for use in, for example, a vehicle air conditioner.

In general, variable displacement compressors are used in vehicle air conditioners. One of the compressors of this type is described in, for example, Japanese Second (examined) Pat. Publication No. 4-74549.

The disclosed compressor is called a wobble plate type variable displacement compressor. The compressor has a compressor casing defining a crank chamber therein. A rotor is disposed in the crank chamber and mounted on a main shaft. A swash plate is attached to the rotor via a hinge mechanism. The main shaft passes through the swash plate. Specifically, a sleeve is attached to the swash plate and receives the main shaft therethrough. A space is formed between an outer periphery of the sleeve and an inner periphery of the swash plate so that an inclination of the swash plate relative to the main shaft can be changed by means of the hinge mechanism.

A wobble plate is rotatably mounted on the swash plate via a bearing. A plurality of piston rods are coupled to the wobble plate through ball connection. The compressor casing is formed with a plurality of cylinders which are arranged at regular intervals so as to surround the main shaft. Each of the piston rods is coupled through ball connection to corresponding one of pistons disposed in the respective cylinders. In the crank chamber, a guide rod is supported by the compressor casing so as to extend in parallel to the main shaft. The guide rod is sandwiched by an end portion of the wobble plate so that the end portion of the wobble plate can wobble relative to the guide rod in an axial direction of the main shaft.

Following the rotation of the main shaft, the rotation of the rotor is transmitted to the swash plate so that the wobble plate wobbles to cause the pistons to make reciprocating motions. In this fashion, the compressing operation is carried out. As described above, since the inclination of the swash plate relative to the main shaft is changeable by means of the hinge mechanism, the piston stroke can be changed by controlling the inclination of the swash plate, thereby to change the compression displacement of the compressor.

In the foregoing wobble plate type variable displacement compressor, an open/close valve is provided in an air feed passage extending from a discharge chamber to the crank chamber for opening and closing the air feed passage so as to control a suction pressure at a given value. A bleed passage is further provided for constantly allowing discharge gas having flowed into the crank chamber through the air feed passage to escape into a suction chamber.

In the foregoing wobble plate type variable displacement compressor, when, for example, the suction pressure is higher than a set value of the open/close valve, the open/close valve is held closed so that the gas in the discharge chamber is not at all fed into the crank chamber while blowby gas introduced upon gas compression flows into the suction chamber via the bleed passage. Thus, a pressure differential between the crank chamber and the suction chamber is very small to cause the compressor to be operated at the maximum displacement.

In that event, lubrication of machine parts in the crank chamber relies on oil staying in the crank chamber.

However, since the oil staying in the crank chamber is splashed to the inner periphery of the crank chamber due to centrifugal forces generated by the rotation of the main shaft and the swash plate, the lubrication of the bearings and the sliding portions near the main shaft becomes insufficient. Thus, depending on the compressor operating condition and the oil stay amount, abrasion or breakage of those machine parts may be caused.

SUMMARY OF THE INVENTION

It is therefore an object of the present invention to provide a variable displacement compressor which can carry out sufficient lubrication of machine parts including a bearing and a sliding portion near a main shaft.

Other objects of the present invention will become clear as the description proceeds.

A variable displacement compressor to which this invention is applicable comprise a compressor housing defining therein a crank chamber, a discharge chamber, and a suction chamber, a main shaft rotatably supported by the compressor housing, a swash plate disposed in the crank chamber and connected to the main shaft to have a variable inclination relative to the main shaft in accordance with a pressure differential which is between the crank chamber and the suction chamber, and a piston coupled to the swash plate for reciprocating in accordance with rotation of the main shaft to displace a fluid from the suction chamber to the discharge chamber in dependence of the variable inclination. According to this invention, the compressor further comprises a first communication passage for establishing communication between the crank chamber and the suction chamber, a first orifice with a fixed opening provided in the first communication passage, a second communication passage for establishing communication between the discharge chamber and the crank chamber, a pressure control valve coupled to the second communication passage for adjusting pressure of the crank chamber, a third communication passage for establishing communication between the discharge chamber and the crank chamber, the third communication passage bypassing the second communication passage, and a second orifice with a fixed opening provided in the third communication passage.

DESCRIPTION OF THE PREFERRED EMBODIMENT

Figure 1:
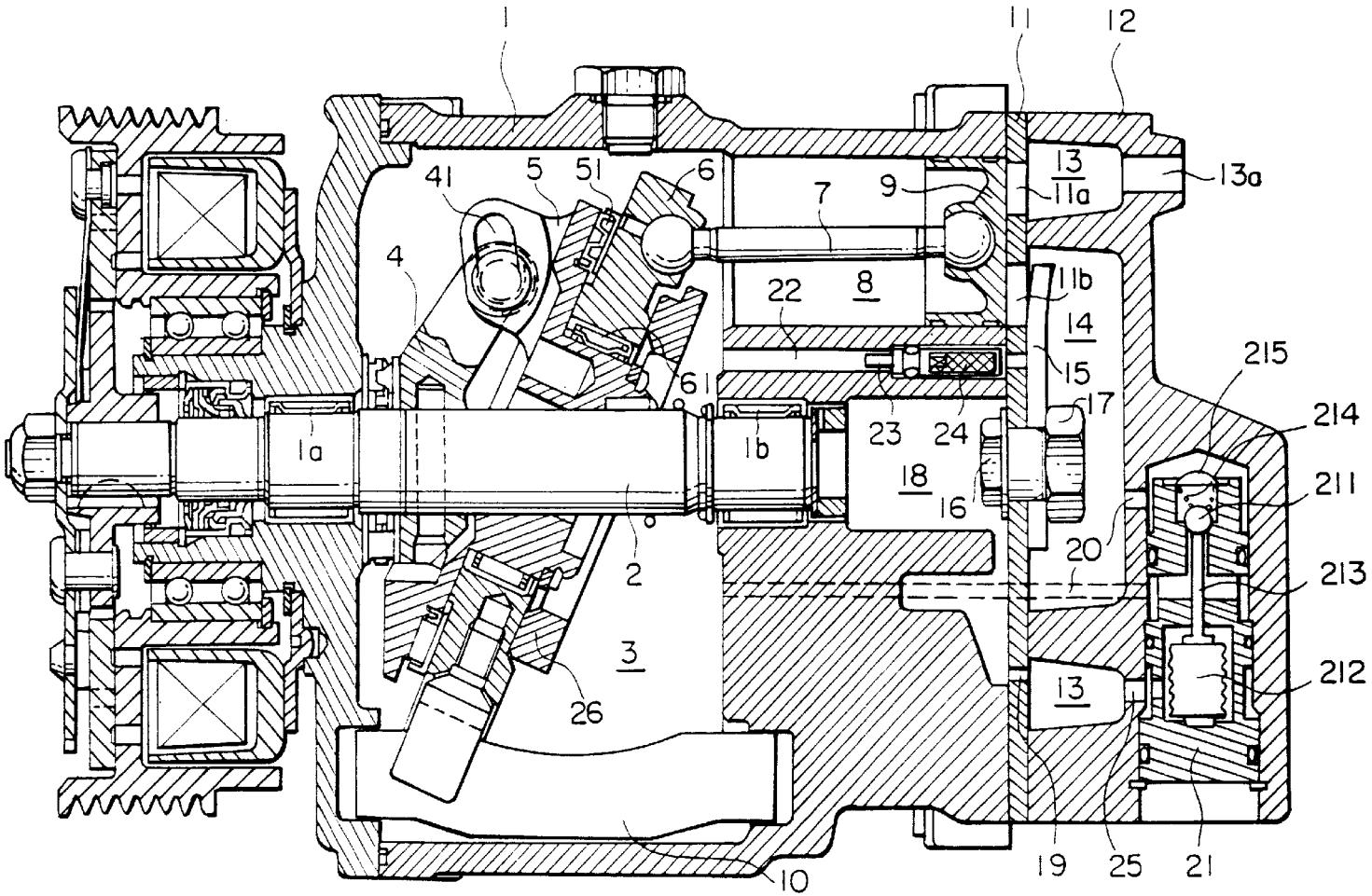
FIG. 1 is a sectional view showing a variable displacement compressor according to a first preferred embodiment of the present invention.

Referring to FIG. 1, description will be made as regards a variable displacement compressor according to the first preferred embodiment of the present invention.

The compressor comprises a compressor casing 1 having a through hole at the center thereof. A main shaft 2 is inserted into this through hole and rotatably supported by the casing 1 via bearings 1*a* and 1*b*.

The casing 1 defines therein a crank chamber 3 wherein a rotor 4 is mounted on the main shaft 2. A swash plate 5 is coupled to the rotor 4 via a hinge mechanism 41. The main shaft 2 passes through the swash plate 5 such that the swash plate 5 abuts the main shaft 2 at an inner periphery thereof so as to be slidable relative to the main shaft 2. An inclination of the swash plate 5 relative to the main shaft 2 can be changed by means of the hinge mechanism 41.

A wobble plate 6 is rotatably mounted on the swash plate 5 via two bearings 51 and 61. A plurality of piston rods 7 are coupled to the wobble plate 6 through ball connection. The casing 1 is formed with a plurality of cylinders 8 which are arranged at regular angular intervals so as to surround the main shaft 2. Each of the piston rods 7 is coupled through ball connection to corresponding one of pistons 9 disposed in the respective cylinders 8.

In the crank chamber 3, a guide rod 10 is supported by the casing 1 so as to extend in parallel to the main shaft 2. The guide rod 10 is sandwiched by an end portion of the wobble plate 6 so that the end portion of the wobble plate 6 can wobble relative to the guide rod 10 in an axial direction of the main shaft 2.

To a right end surface in the figure of the casing 1, a cylinder head 12 is attached via a valve plate 11 interposed therebetween, so as to close a right-side open end of the casing 1. The casing 1 and the cylinder head 12 constitute a compressor housing. The cylinder head 12 is formed with a suction chamber 13 and a discharge chamber 14. The suction chamber 13 communicates with a suction port 13*a*, while the discharge chamber 14 communicates with a discharge port (not shown). The valve plate 11 is formed with suction holes ll*a* and discharge holes 11*b*. The suction chamber 13 and the discharge chamber 14 communicate with the cylinders 8 via the suction holes 11*a* and the discharge holes 11*b*, respectively.

At the center of the valve plate 11, a suction valve (not shown), a discharge valve (not shown) and a valve retainer 15 are fixedly mounted by means of a bolt 16 and a nut 17.

In a first communication passage 18 extending from the crank chamber 3 to the suction chamber 13 via gaps between the main shaft 2 and the bearing 1*b*, a first orifice 19 with a fixed opening is provided so that the amount of gas flowing out from the crank chamber 3 into the suction chamber 13 is controlled by the first orifice 19.

On the other hand, a pressure control valve 21 is disposed in a second communication passage 20 establishing communication between the discharge chamber 14 and the crank chamber 3. By open/close controlling the pressure control valve 21, the amount of discharge gas introduced from the discharge chamber 14 into the crank chamber 3 is adjusted.

The compressor further comprises a third communication passage 22 which is for establishing communication between the discharge chamber 14 and the crank chamber 3 to bypass the second communication passage The third communication passage 22 is placed adjacent to the main shaft 2 and extends substantially parallel to the main shaft 2.

A second orifice 23 with a fixed opening is provided in the third communication passage 22. A filter 24 is disposed at an inlet side of the second orifice 23.

Now, the description will be directed to a structure of the pressure control valve 21.

The pressure control valve 21 comprises a valve member 211 for opening and closing the communication passage 20 and a bellows 212. The inside of the bellows 212 is under vacuum and provided with a spring. The bellows 212 is sensitive to a pressure in the suction chamber 13 via a communication passage 25. A transfer rod 213 is attached to the bellows 212 and operates the valve member 211 in response to expansion and contraction of the bellows 212 so as to open and close the communication passage 20. As seen from the figure, the valve member 211 is biased by a spring 214 in a direction to close the communication passage 20. A filter 215 is further provided at an inlet side of the valve member 211. Accordingly, the pressure control valve 21 carries out an open/close control of the valve member 211 in response to the pressure in the suction chamber 13 monitored by the bellows 212. The pressure control valve 21 has a pressure control characteristic as shown, for example, in FIG. 2, wherein a suction pressure (Ps) linearly decreases as a discharge pressure (Pd) increases. In the pressure control characteristic shown in FIG. 2, when the discharge pressure is 15 kg/cm$^2$G, the suction pressure becomes 1.7 kg/cm$^2$G.

Figure 2:
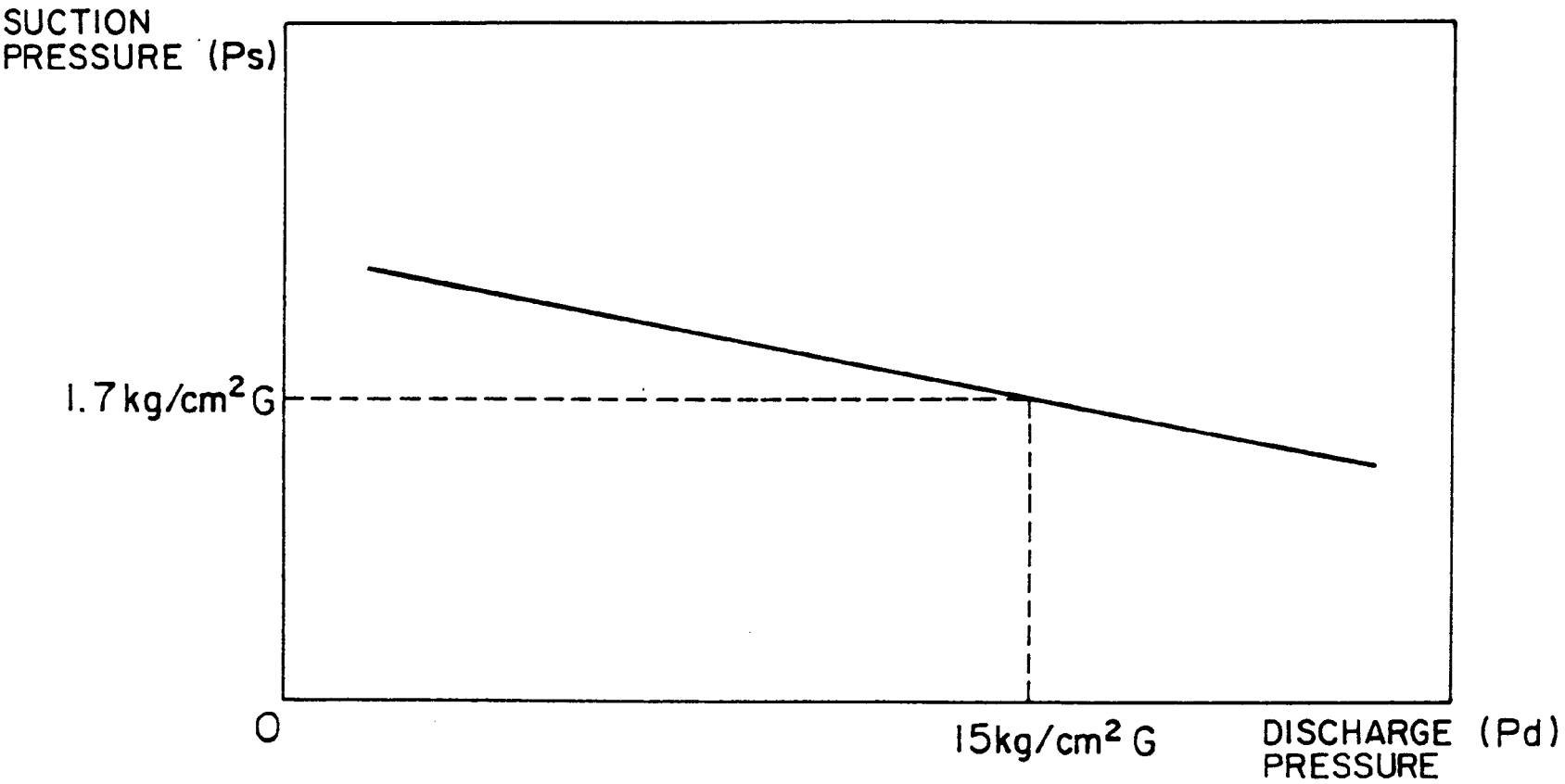
FIG. 2 is a diagram showing a pressure control characteristic of a pressure control valve shown in FIG. 1.

Referring to FIG. 2 together with FIG. 1, the description will be made as regards an operation of the variable displacement compressor.

In the state wherein the compressor is stopped, the pressures in the refrigeration circuit are balanced. For example, given that a balance pressure is 6 kg/cm$^2$G, since the balance pressure is higher than the pressure control characteristic shown in FIG. 2, the bellows 212 is contracted so that the valve member 211 closes the communication passage 20.

If the compressor is started from the foregoing state, since the pressure control valve 21 is closed, the discharge gas is introduced into the crank chamber 3 only through the second orifice 23. In consideration of the amount of discharge gas introduced via the second orifice 23 and the amount of blowby gas introduced upon gas compression by the pistons 9, an open area of the first orifice 19 is set to a value which does not cause a pressure loss at the first orifice 19. Therefore, a pressure differential between the crank chamber 3 and the suction chamber 13 does not increase to a level which changes the inclination of the swash plate 5, and thus, the inclination of the swash plate 5 becomes maximum to operate the compressor at the maximum piston stroke.

In this state, since the discharge gas is constantly introduced into the crank chamber 3 via the second orifice 23, lubrication is carried out by the oil contained in the discharge gas flow with respect particularly to sliding portions between the wobble plate 6 and a balance ring 26, a bearing 61 and a bearing 51.

When the pressure in the suction chamber 13 reaches a given value (for example, 1.7 kg/cm$^2$G in FIG. 2), the bellows 212 expands so that the transfer rod 213 pushes up the valve member 211 to open the communication passage 20. Thus, a large amount of the discharge gas flows into the crank chamber 3. However, since a large amount of the gas in the crank chamber 3 can not escape into the suction chamber 13 via the first orifice 19, the pressure in the crank chamber 3 increases. Specifically, a pressure differential between the crank chamber 3 and the suction chamber 13 increases to diminish the inclination of the swash plate 5, thereby to reduce the piston stroke.

Following the reduction in piston stroke, the pressure in the suction chamber 13 starts to increase. Then, the bellows 212 is contracted to operate the valve member 211 in a direction to close the communication passage 20. Hence, the introduction amount of the discharge gas from the discharge chamber 14 into the crank chamber 3 is reduced so that a pressure differential between the crank chamber 3 and the suction chamber 13 is diminished to increase the inclination of the swash plate 5. This enlarges the piston stroke.

In the foregoing fashion, the opening degree of the valve member 211 is controlled to converge the pressure in the suction chamber 13 to a set pressure of the pressure control valve 21, thereby to control the discharge displacement of the compressor.

Figure 3:
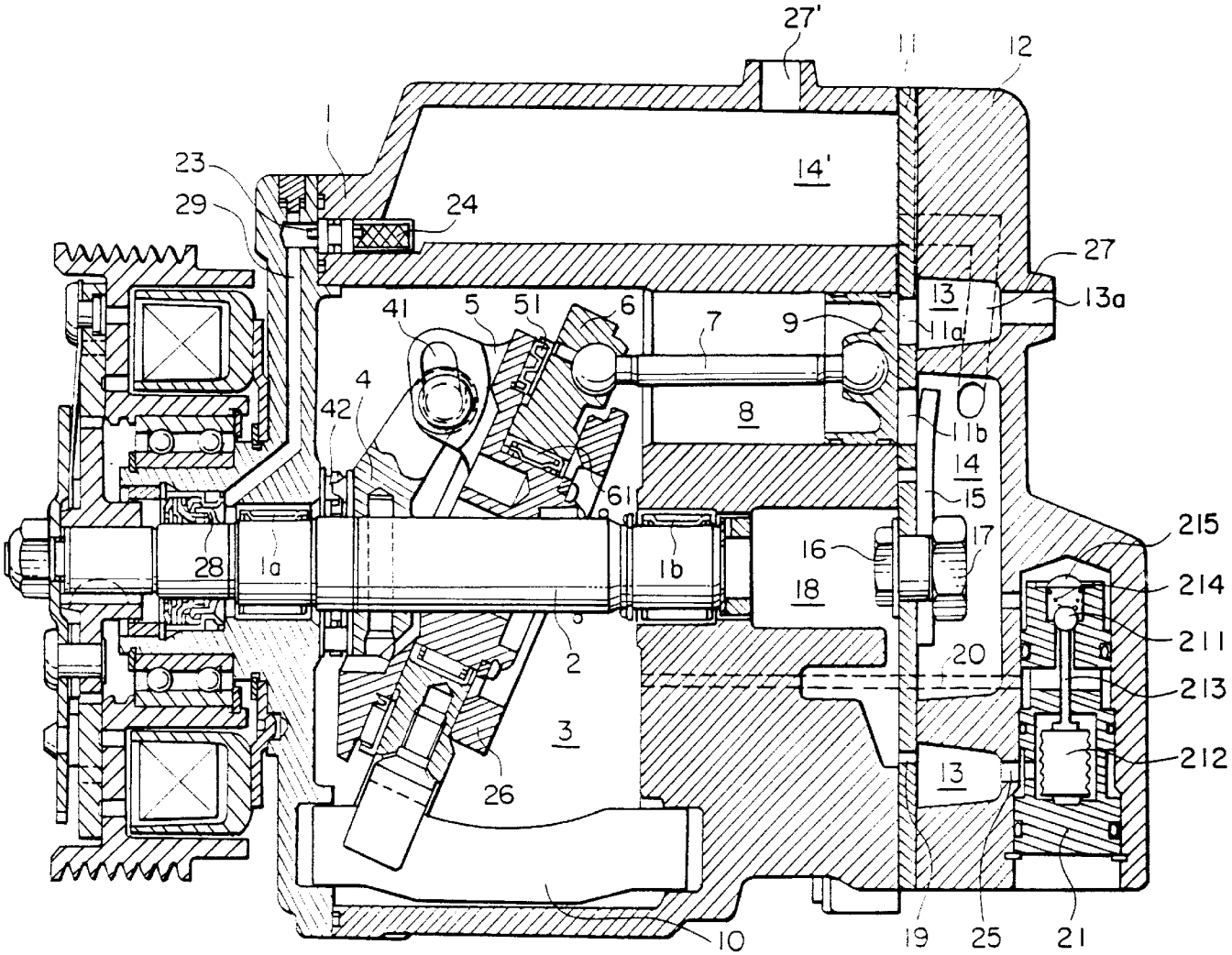
FIG. 3 is sectional view showing a variable displacement compressor according to a second preferred embodiment of the present invention.

Referring now to FIG. 3, the description will be made as regards a variable displacement compressor according to the second preferred embodiment of the present invention. The variable displacement compressor comprises similar parts designated by like reference numerals.

The compressor further comprises an additional discharge chamber 14' also defined by the compressor casing 1 at an upper portion thereof. The additional discharge chamber 14' is connected to the first-mentioned discharge chamber 14 through a discharge passage 27. A discharge port 27' is connected to the additional discharge chamber 14'. The discharge gas is discharged from the compressor through the discharge chamber 14, the discharge passage 27, the additional discharge chamber 14', and the discharge port 27' in the order named. In this event, the additional discharge chamber 14' serves as a muffler chamber known in the art.

In the manner known in the art, a shaft seal unit 28 is interposed between the compressor housing 1 and the main shaft 2 for substantially preventing the crank chamber 3 from be communicated with an external area of the compressor. A local passage 29 is formed in the compressor housing 1 to extend from the lowermost portion of the additional discharge chamber 14' to a portion which is between the bearing 1*a* and the shaft seal unit 29.

The filter 24 and the second orifice 23 are provided to the local passage 29. The oil contained in the discharge gas flows into the local passage 29 through the filter 24 and the second orifice 23 and then is supplied to the bearing 1*a* and a bearing 42 in the order named. So that, machine parts of the compressor are constantly lubricated with the oil contained in discharge gas. A combination of the discharge passage 27, the additional discharge chamber 14', the local passage 29, the bearings 1*a* and 42 is referred to as a third communication passage.

In the foregoing preferred embodiments, the present invention is applied to the wobble plate type variable displacement compressor. However, the present invention is also applicable to a single swash plate type variable displacement compressor.

Figure 4:
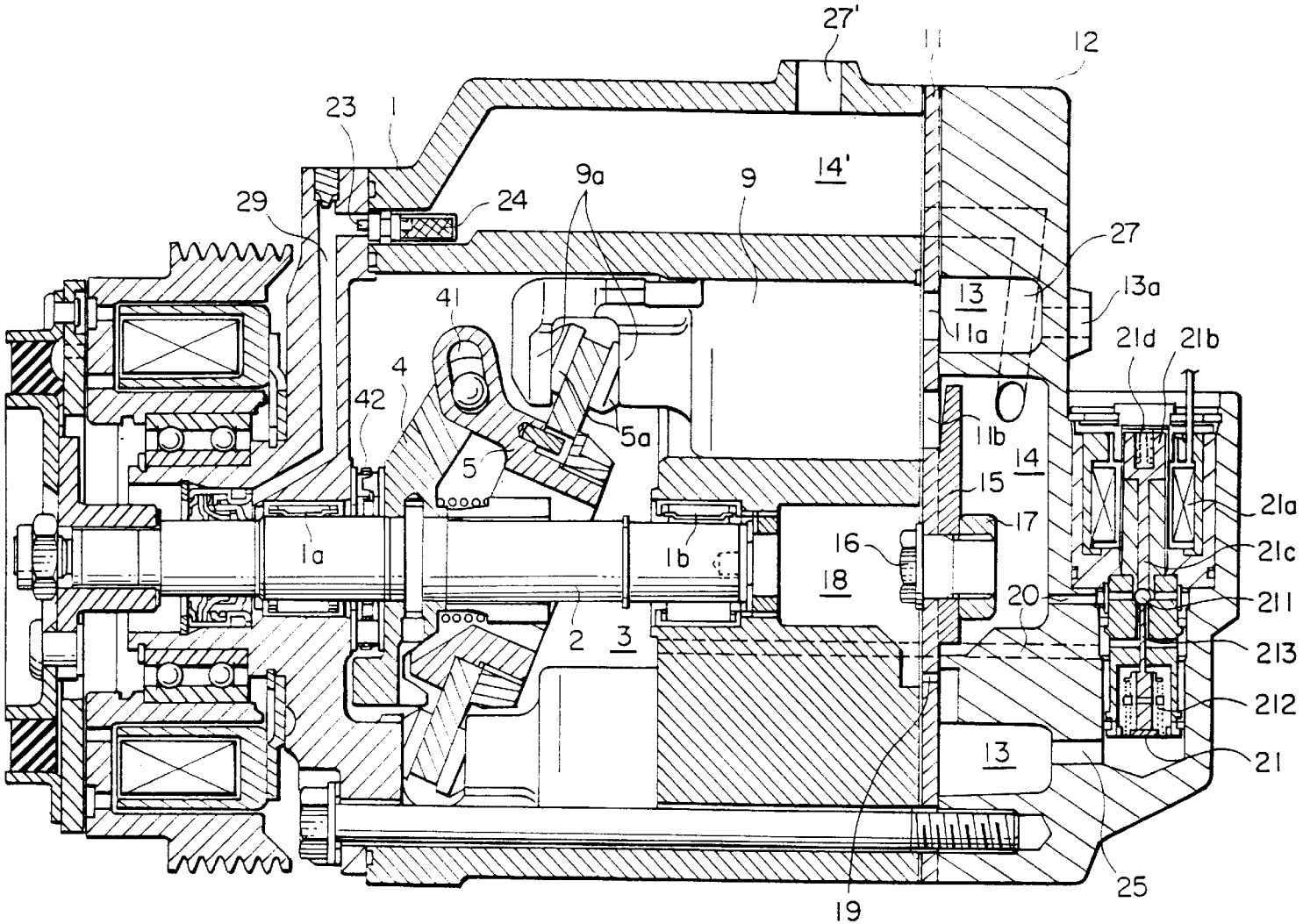
FIG. 4 is a sectional view showing a variable displacement compressor according to a third preferred embodiment of the present invention.

Referring now to FIG. 4, the description will be made as regards a variable displacement compressor according to the third preferred embodiment of the present invention. The shown compressor is so-called a single swash plate type variable displacement compressor and comprises similar parts designated by like reference numerals.

In the single swash plate type variable displacement compressor, pistons 9 are directly coupled to a swash plate 5. Specifically, a pair of sliding shoes 5*a* are attached to both sides of the swash plate 5. Each of the sliding shoes 5*a* has a spherical surface. The piston 9 has at one end thereof a holding portion 9*a* which holds the pair of sliding shoes 5*a* in a sandwiched fashion so as to be slidable on the surfaces of the sliding shoes 5*a*. With this arrangement, when the swash plate 5 rotates following the rotation of a rotor 4, the rotation of the swash plate 5 is converted into reciprocating motions of the pistons 9. The piston stroke is proportional to the inclination of the swash plate 5.

The variable displacement compressor uses a pressure control valve 21 which is operated by an external signal. The shown pressure control valve 21 is provided with a valve member 211 for opening and closing the communication passage 20, and further provided with a bellows 212. The inside of the bellows 212 is under vacuum and provided with a spring. The bellows 212 is sensitive to a pressure in a suction chamber 13 via a communication passage 25. A transfer rod 213 is attached to the bellows 212 and operates the valve member 211 in response to expansion and contraction of the bellows 212 so as to open and close the communication passage 20.

The pressure control valve 21 is further provided with an electromagnetic coil 21*a* confronting the bellows 212, and a plunger 21*b* surrounded by the electromagnetic coil 21*a*. The plunger 21*b* is slidable relative to the electromagnetic coil 21*a* and fixed with a transfer rod 21*c* at its tip. The plunger 21*b* is provided with a spring 21*d* so that the transfer rod 21*c* presses the valve member 211 in a closing direction depending on an electromagnetic force of the electromagnetic coil 21*a* and a biasing force of the spring 21*d*.

Specifically, the pressure control valve 21 carries out an open/close control of the valve member 211 in response to the pressure in the suction chamber 13 monitored by the bellows 212. And, a set pressure of the pressure control valve 21 changes depending on the amount of current supplied to the electromagnetic coil 21*a*.

In the variable displacement compressor shown in FIG. 4, circulation of the oil is the same as that in the compressor shown in FIG. 3 so that explanation thereof is omitted.

In each of the foregoing preferred embodiments, the discharge chamber and the crank chamber constantly communicate with each other via the second orifice provided in the third communication passage, even when the pressure control valve is fully closed. Therefore, the discharge gas in the discharge chamber constantly flows into the crank chamber so as to lubricate the inside of the crank chamber, including the bearings and the sliding portions near the main shaft, by the oil contained in the discharge gas flow. Thus, breakage of the bearings or abrasion of the sliding portions can be prevented. Further, by forming the third communication passage so as to extend from the discharge chamber to the crank chamber via the shaft seal unit of the main shaft, it is possible to feed the oil to the shaft seal unit.

What is claimed is:

1. A variable displacement compressor comprising a compressor housing defining therein a crank chamber, a discharge chamber, and a suction chamber, a main shaft rotatably supported by said compressor housing, a swash plate disposed in said crank chamber and connected to said main shaft to have a variable inclination relative to said main shaft in accordance with a pressure differential which is between said crank chamber and said suction chamber, and a piston coupled to said swash plate for reciprocating in accordance with rotation of said main shaft to displace a fluid from said suction chamber to said discharge chamber in dependence of said variable inclination, said compressor comprising:

a first communication passage for establishing communication between said crank chamber and said suction chamber;

a first orifice with a fixed opening provided in said first communication passage;

a second communication passage for establishing communication between said discharge chamber and said crank chamber;

a pressure control valve coupled to said second communication passage for adjusting pressure of said crank chamber;

a third communication passage for establishing communication between said discharge chamber and said crank chamber, said third communication passage bypassing said second communication passage; and a second orifice with a fixed opening provided in said third communication passage;

wherein said main shaft penetrates said compressor housing, and said compressor further comprising a bearing for permitting said main shaft to smoothly be rotated, said third communication passage extending from said discharge chamber to said crank chamber via said second orifice and said bearing.

2. A variable displacement compressor as claimed in claim 1, wherein said third communication passage is placed adjacent to said main shaft and extends substantially parallel to said main shaft.

3. A variable displacement compressor as claimed in claim 1, further comprising a shaft seal unit interposed between said compressor housing and said main shaft for substantially preventing said crank chamber from communicating with an external area of said compressor, said third communication passage having a part extending from said discharge chamber to a portion which is between said shaft seal unit and said bearing.

4. A variable displacement compressor as claimed in claim 1, wherein said third communication passage comprises:

a muffler chamber defined by said compressor housing;

a discharge passage for establishing communication between said discharge chamber and said muffler chamber; and a local passage for establishing communication between said muffler chamber and said bearing.

5. A variable displacement compressor as claimed in claim 4, wherein said second orifice is attached to said local passage.

6. A variable displacement compressor as claimed in claim 1, wherein said pressure control valve is responsive to pressure of said suction chamber to control said second communication passage.

7. A variable displacement compressor as claimed in claim 1, wherein said pressure control valve is responsive to an external signal to control said second communication passage.

8. A variable displacement compressor as claimed in claim 1, wherein said compressor further comprises a bearing for permitting said main shaft to smoothly be rotated, and wherein said first communication passage extends from said crank chamber to said suction chamber via a gap between said main shaft and said bearing.

* * * * *